US007285923B2

(12) United States Patent
Yu

(10) Patent No.: US 7,285,923 B2
(45) Date of Patent: Oct. 23, 2007

(54) DISPLAY APPARATUS AND DRIVING PULSE CONTROL METHOD THEREOF

(75) Inventor: Byung-Cheol Yu, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/252,814

(22) Filed: Oct. 19, 2005

(65) Prior Publication Data

US 2006/0132402 A1 Jun. 22, 2006

(30) Foreign Application Priority Data

Dec. 17, 2004 (KR) ..... 10-2004-0107651

(51) Int. Cl.
*H05B 37/02* (2006.01)
*G09G 3/32* (2006.01)

(52) U.S. Cl. ..... 315/307; 315/224; 315/291; 315/176; 345/83; 345/89; 345/156; 345/691

(58) Field of Classification Search ..... 315/291, 315/224, 307; 345/46, 83; 323/285, 267
See application file for complete search history.

(56) References Cited

U.S. PATENT DOCUMENTS 6,909,249 B2 * 6/2005 Otake ..... 315/291
7,034,607 B2 * 4/2006 Otake ..... 327/590
7,106,037 B2 * 9/2006 Ohtake et al. ..... 323/285
2001/0043113 A1 * 11/2001 Hoshino et al. ..... 327/534
2005/0200312 A1 * 9/2005 Komiya et al. ..... 315/291
2005/0243022 A1 * 11/2005 Negru ..... 345/46

FOREIGN PATENT DOCUMENTS

| | | |
|---|---|---|
| JP | 10-39836 | 2/1998 |
| JP | 2002-343586 | 11/2002 |
| JP | 2003-249383 | 9/2003 |
| JP | 2003-345309 | 12/2003 |
| KR | 2002-0037212 | 5/2002 |

* cited by examiner

*Primary Examiner*—Douglas W. Owens
*Assistant Examiner*—Chuc Tran
(74) *Attorney, Agent, or Firm*—Roylance, Abrams, Berdo & Goodman, LLP

(57) ABSTRACT

An apparatus and method is disclosed for controlling a display driving pulse to drive an LED display. In one embodiment, an RGB signal is received and a period during which all the LEDs are switched off is detected. Also, the period during which an image is not being displayed is also detected. The driving time of each LED is then extended by the detected periods so that the lighting time of the LED is extended, and brightness of the display as a whole is improved using the LED system.

34 Claims, 5 Drawing Sheets

DISPLAY APPARATUS AND DRIVING PULSE CONTROL METHOD THEREOF

CROSS-REFERENCE TO RELATED APPLICATIONS

This application claims benefit under 35 U.S.C. §119(a) of Korean Patent Application No. 2004-107651, filed Dec. 17, 2004, in the Korean Intellectual Property Office, the entire contents of which are hereby incorporated by reference.

BACKGROUND OF THE INVENTION

1. Field of the Invention

The present invention relates to a display apparatus. More specifically, the invention relates to a method of controlling a driving pulse that drives a display apparatus formed of light emitting diodes (LEDs).

2. Description of the Related Art

Generally, light emitting diodes consume less power, emit less heat, are small and light, and can be driven by low-voltage direct current power. Light emitting diodes are typically used as pilot lamps, in other words, indicators, in various electronic/electric and industrial products.

Recently, light emitting diodes have attained a level of brightness that they are now widely used as warning lights on roads or the like, and are used as the light source of display devices such as light panels, subway guide electric signboards, and public relations and advertisement signboards. Light emitting diodes having light directionality can be used as a light source in a transparent liquid crystal display (LCD), in other words, a display apparatus.

A light emitting diode (hereinafter "LED") utilizes the light generated when a hole and an electron recombine at the junction of p-type and n-type semiconductor materials, and have a much faster response time than a filament-type lamp. However, as an LED switches on and off it flashes at full brightness immediately after switching on, and then light disappears instantly when the LED is switched off.

Generally, direct current constant voltage is used as the input of a driving circuit for lighting an LED, and the brightness of an LED can be controlled by controlling the voltage intensity or current. LED switching is controlled through the ON/OFF control of direct current voltage, or the ON/OFF control of the current path of an LED.

When driving an LED corresponding to a pixel in a display area, an LED driving signal is controlled by a driving waveform, as shown in FIG. 1. The driving waveform is generated by an LED driving signal generator and supplied to a current converter, which converts the driving signal into current, thus controlling LED switching. FIGS. 1(*a*), (*b*), and (*c*) illustrate three driving signals for driving RGB LEDs. If the ON-signal current detected by a current detector is more than a predetermined current level, a current controller will decrease the current; if the detected current is less than a predetermined current level, the current controller will increase the current, thus enabling the LED to maintain constant brightness.

As shown in FIG. 1, the driving signal generated by the LED driving signal generator is similar to an ideal pulse (e.g. has a predetermined pulse width 'P' as indicated in FIG. 1(*c*)). However, the signal that passes through a voltage-current converter and an LED experiences a transition time, rising time, overshoot, and fall time, as shown in FIG. 1(*d*).

Overshoot occurs when a signal is converted into a pulse. Overshoot generates signal distortion and causes a time period to occur in which each LED is simultaneously turned off. Thus, signals distorted by overshoot cannot effectively be used to drive LEDs.

FIG. 2 illustrates three RGB driving waveforms on the same line consecutively, demarcated as shown in FIG. 2(*a*).

The general response characteristics of an LED are such that the rise time is longer than the fall time. Also, LEDs require a certain voltage threshold before they turn on., shown in FIG. 2(*b*) as "th". Accordingly, there is a period during which each RGB LED is turned off, shown in FIG. 2(*b*) as "y". In addition, overshoot is generated when a waveform is converted into a pulse, shown in FIG. 2(*b*) as "x". Signal distortion occurs if the signal is displayed during this overshoot period, so the overshoot period is not used.

Considering that technology for improving light-collecting efficiency and brightness of a light source is extremely important in a display apparatus, conventional LED driving methods, as explained above, fail to maximize the efficiency of an LED.

SUMMARY OF THE INVENTION

The present invention provides a display apparatus and method of controlling a driving pulse in which an image can be displayed for an extended period of time by improving the driving pulse of an LED, thereby improving the brightness of the display apparatus as a whole.

According to one aspect of the invention, a device is provided for driving a light emitting diode comprising one or more LEDs, an LED driver for outputting a driving signal for controlling LED switching, and a period detector for detecting a period where all the driving signals applied to each light emitting diode are turned off. The period detector outputs the detected period to the LED driver, which adds the period detected to the turn-on driving signal of each light emitting diode so that the driving signals overlap each other by the period detected.

The LED driver further adds the period not being used for displaying an image to the turn-on driving signal of the light emitting diode and applies the added driving signal. The driving signal can be a square waveform having a predetermined pulse width.

In addition, the LED driver includes a display device driver for outputting data for controlling the ON/OFF switching of each light emitting diode, a driving signal generator for receiving data from the display device driver and outputting a voltage driving signal for controlling the ON/OFF switching of each light emitting diode, and a voltage-current converter for converting the voltage driving signal outputted from the driving signal generator to a current driving waveform for controlling the brightness of the light emitting diode and applying the current driving waveform to the light emitting diode. In one embodiment, the voltage driving signal is a square waveform.

The period detector preferably receives the current driving waveform applied to the light emitting diode from the voltage-current converter and performs period detection.

The voltage-current converter preferably detects the amount of current flowing through the light emitting diode in order to control the amount of current so that the current which flows through the light emitting diode is constant.

According to an aspect of the present invention, the display apparatus using a light emitting diode according to the invention includes an LED driver for outputting a driving signal for controlling the ON/OFF switching of each light emitting diode, and a current detector for detecting the amount of current flowing through each light emitting diode.

The LED driver receives the detected data from the current detector and controls the amount of current so that the current which flows through the light emitting diode is constant.

In another aspect of the present invention, the display apparatus further includes a period detector for detecting a period where all the driving signals applied to each light emitting diode are turned off and outputting the detected period to the LED driver The LED driver adds the period detected by the period detector to the turn-on driving signal of the light emitting diode and thus the turn-on driving signals overlap each other by the period detected.

The LED driver further adds the period not being used for displaying an image to the turn-on driving signal of the light emitting diode and applies the added driving signal, the driving signal can be a square waveform having a predetermined pulse width.

On the other hand, the LED driver can include a display device driver for outputting data for controlling the ON/OFF switching of each light emitting diode, a driving signal generator for receiving data from the display device driver and outputting a voltage driving signal for controlling the ON/OFF switching of each light emitting diode, and a voltage-current converter for converting the voltage driving signal outputted from the driving signal generator to a current driving waveform for controlling the brightness of the light emitting diode and applying the current driving waveform to the light emitting diode. The voltage driving signal can be a square waveform.

The period detector receives the current driving waveform applied to the light emitting diode from the voltage-current converter and performs period detection. Preferably, the voltage-current converter further receives the amount of current detected by the current detector and controls the amount of current so that the current flow through the light emitting diode is constant.

According to another aspect of the invention, there is provided a method of controlling the driving pulse of a display apparatus using one or more light emitting diodes. In this method, a period where all the light emitting diodes are turned off is detected and added to a turn-on driving signal of the light emitting diode, so that the turn-on driving signals are outputted while overlapping each other by the detected period. The method further adds the period not being used for displaying an image to the turn-on driving signal of the light emitting diode and applies the added driving signal.

In another aspect of the present invention, there is provided a method of controlling the driving pulse of a light emitting diode that includes outputting a driving signal for controlling the ON/OFF switching of each light emitting diode, detecting a period where all the driving signals applied to the light emitting diode are turned off, and applying the turn-on driving signals so that each signal overlaps each other by the period detected. The turn-on driving signal is applied to each light emitting diode after adding the period detected at the period detecting step.

The applying step preferably further adds the period not being used for displaying an image to the turn-on driving signal of the light emitting diode and applies the added driving signal.

The driving signal outputting step includes steps of: outputting control data for controlling the ON/OFF switching of each light emitting diode, outputting a voltage driving signal for controlling the ON/OFF switching of each light emitting diode after receiving the data from the control data outputting step, and applying a current driving waveform to the light emitting diode after converting the voltage driving signal into the current driving waveform for controlling the brightness of the light emitting diode. In one embodiment, the voltage driving signal is a square wave.

On the other hand, the period detecting step receives the current driving waveform applied to the light emitting diode at the current driving waveform applying step and performs period detection.

The current driving waveform applying step preferably includes the step of detecting the amount of current flowing through the light emitting diode in order to control the amount of current so that the current flows constantly through the light emitting diode.

In addition, a method of controlling the driving pulse of the display apparatus using a light emitting diode for achieving the objects of the invention comprises steps of outputting a driving signal for controlling the ON/OFF switching of each light emitting diode, detecting the amount of the current flowing through each light emitting diode, and controlling the amount of the current so that the current flows through the light emitting diode constantly after receiving the detected data from the current amount detecting step.

In addition, the method of controlling the driving pulse further comprises steps of detecting a second period where all the driving signals applied to the light emitting diode are turned off and outputting the detected second period to the LED driver, and outputting the turn-on driving signals overlapping each other by the second period detected after adding the period detected at the period detecting step to the turned-on driving signal of each light emitting diode.

The overlapped driving signal outputting step adds the second period not being used for displaying an image to the turn-on driving signal of each light emitting diode and applies the added driving signal. In one embodiment the driving signal is a square waveform.

On the other hand, the driving signal outputting step includes steps of outputting data for controlling the ON/OFF switching of each light emitting diode, outputting a voltage driving signal for controlling the ON/OFF switching of each light emitting diode after receiving data from the voltage driving signal outputting step, and applying the current driving waveform to the light emitting diode after converting the voltage driving signal to the current driving waveform for controlling the brightness of the light emitting diode.

The period detecting step receives the current driving waveform and performs period detection, including detecting the amount of the current flowing through the light emitting diode in order to control the amount of current so that the current flows constantly through the light emitting diode.

BRIEF DESCRIPTION OF THE DRAWINGS

The above aspects and features of the present invention will be more apparent by describing certain exemplary embodiments of the present invention with reference to the accompanying drawings, in which.

Throughout the drawings, like reference numbers should be understood to refer to like elements, features and structures.

DETAILED DESCRIPTION OF EXEMPLARY EMBODIMENTS

Hereinafter, exemplary embodiments of the present invention will be described in greater detail with reference to the accompanying drawings.

The matters defined in the description, such as a detailed construction and elements, are provided to assist in a comprehensive understanding of exemplary embodiments of the present invention. Accordingly, those of ordinary skill in the art will recognize that various changes and modifications of the exemplary embodiments described herein can be made without departing from the scope and spirit of the claimed invention. Also, descriptions of well-known functions and constructions are omitted for clarity and conciseness.

Figure 3:
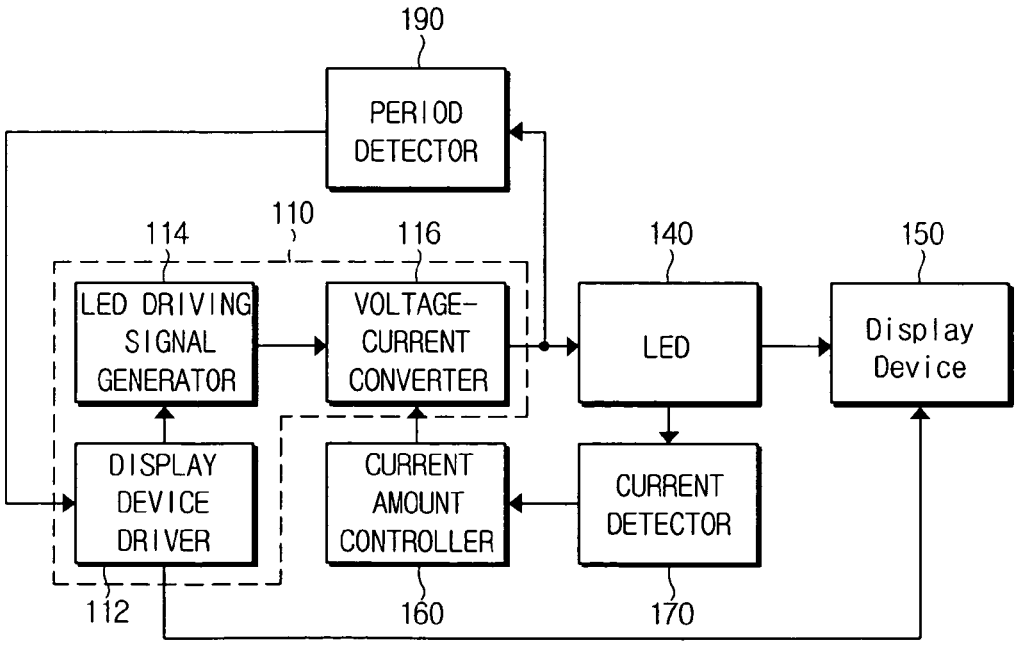
FIG. 3 illustrates a schematic block diagram showing a display apparatus using an LED driving method according to an embodiment of the present invention.

FIG. 3 illustrates a schematic block diagram featuring a display apparatus using an LED driving method according to an embodiment of the present invention. The display apparatus using the LED driving method comprises an LED driver 110 for outputting a driving signal in order to control the ON/OFF switching of an LED, an LED 140, a display device 150, a current detector 170, a current controller 160, and a period detector 190.

The LED 140 is generally formed of a diode or an array of Red-Green-Blue (RGB) light emitting diodes, also referred to herein as a light emitting diode array, and configured to receive R-frame data, G-frame data, and B-frame data so that each of the RGB light emitting diodes or the light emitting diodes in the array may be switched ON or OFF.

The display device 150 comprises a general projection tool and is formed of elements for displaying an image. Such display devices can include, for example, Digital Micromirror Devices (DMD) or Liquid Crystal on Silicon (LCoS). The display device is configured to receive a driving signal from a display device driver 112 as a driving signal for driving an actuator (not shown), and display the RGB light source that emits light through LED 140 on a panel.

The current detector 170 is configured to detect the amount of current passing through LED 140. The current controller 160 receives the signal detected by the current detector 170, and outputs the compared data to a voltage-current converter 116 in order to compare the signal with a reference value and maintain a constant amount of current flowing through LED 140. That is, if the detected current is above a predetermined current level, the current is decreased, and if the detected current is below a predetermined current level, the current is increased. In this manner, a flow of constant current is maintained through the LED.

The controller 110 includes an LED driving signal generator 114, a voltage-current converter 116, and a display device driver 112.

The voltage-current converter 116 is configured to generate a pulse-type current from the voltage driving signal outputted by the LED driving signal generator 114. The voltage-current converter 116 provides an ON/OFF switching current signal for controlling the brightness of LED 140 directly. In addition, voltage-current converter 116 receives compared data from current controller 160 and maintains a constant current flowing through LED 140. In one exemplary embodiment, the voltage driving signal is a square wave.

Figure 1:
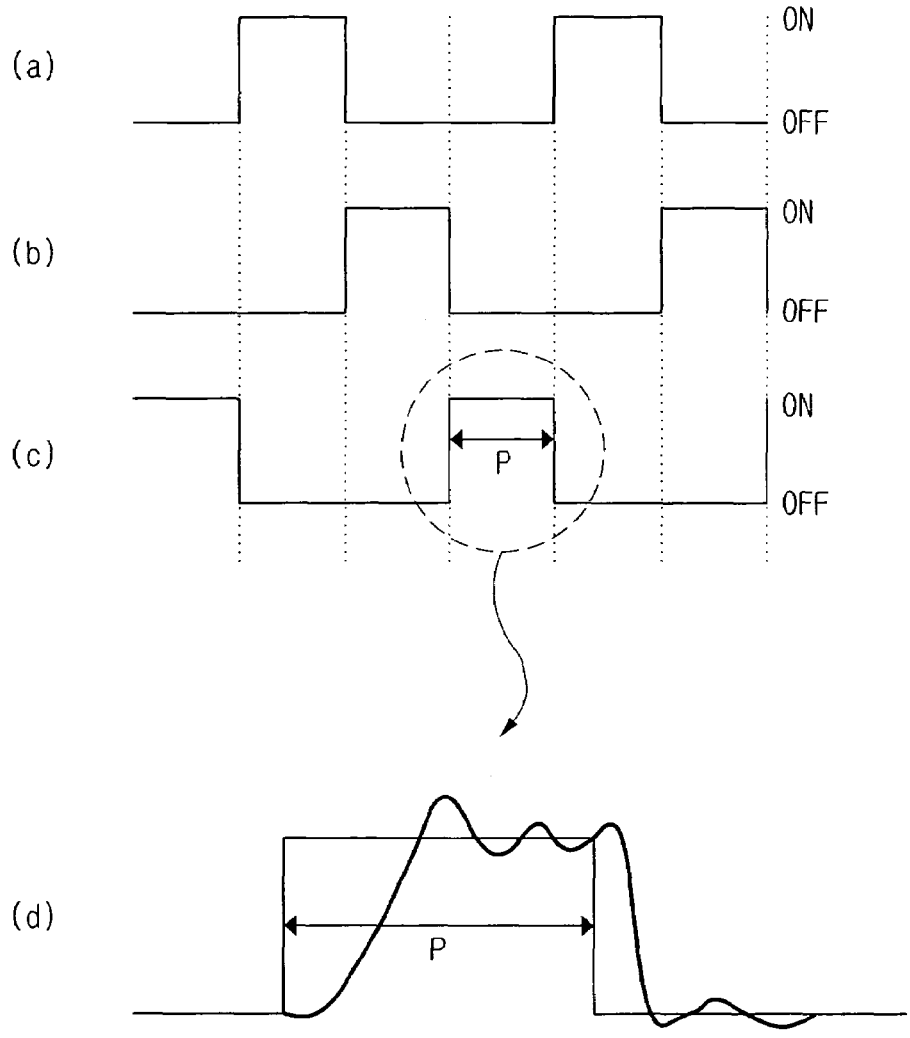
FIG. 1 (PRIOR ART)
FIG. 1 shows the waveform response characteristics of a conventional LED.
Figure 2:
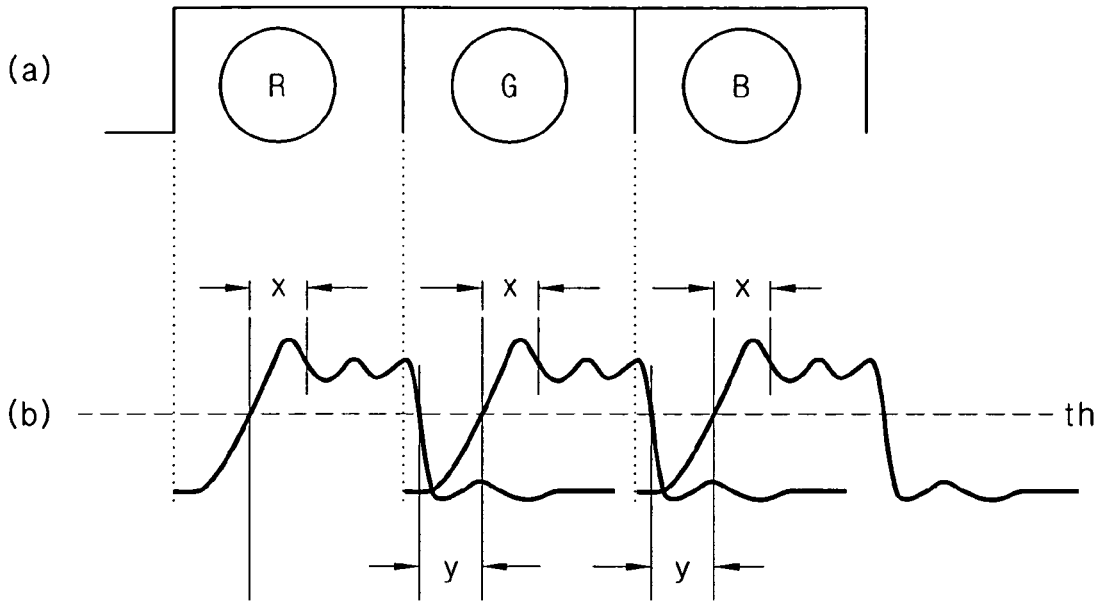
FIG. 2 (PRIOR ART)
FIG. 2 shows a period where the LED does not emit light with R, G, and B waveforms shown on the same line.

The LED driving signal generator 114 receives R-frame data, G-frame data, and B-frame data from the display device driver 112 and generates a voltage driving signal for controlling the ON/OFF switching of each LED 140. The voltage driving signal can be a square wave (e.g., a square waveform having a predetermined pulse width exemplified by '$R_F$,' '$G_F$' or '$B_F$' in FIG. 4(*a*) or 'P' in FIG. 1).

The period detector 190 is configured to receive the current pulse waveform applied to LED 140 from the voltage-current converter 116. Period detector 190 compares the RGB current driving pulses with each other in order to identify a period during which the LED is turned off between signals. Period detector 190 calculates the width d1 of the period where the LED is turned off, and applies the calculated width to display device driver 112. The controller 110, current controller 160, current detector 170 and/or the period detector 190 can be implemented via instructions on a computer readable medium.

Figure 4:
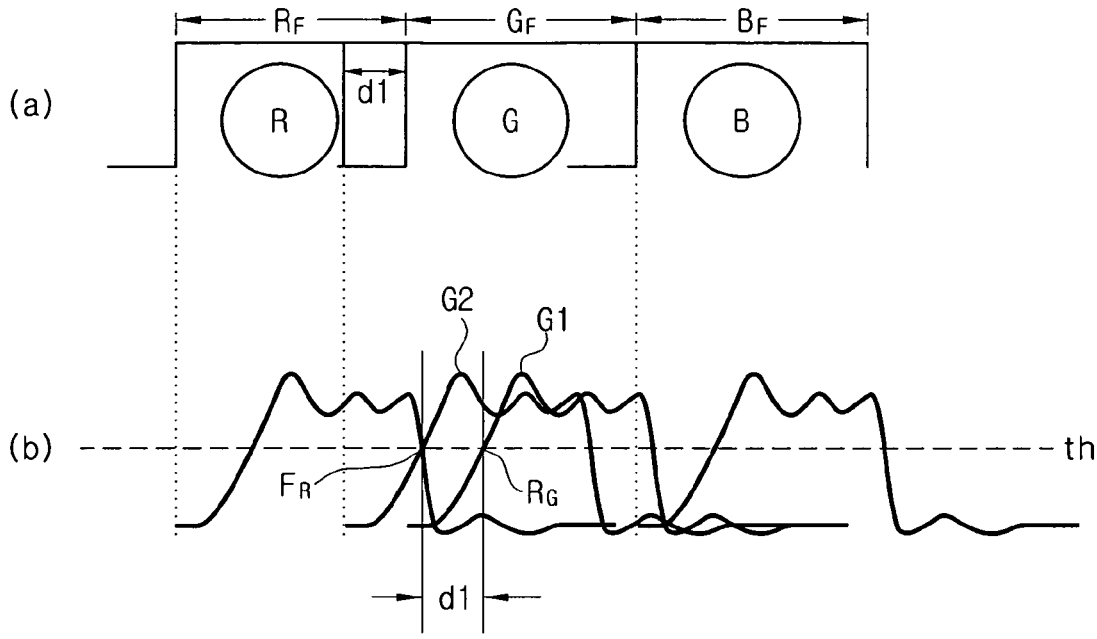
FIG. 4 shows a turn-off period of the LED.

Referring to FIG. 4, the method of calculating width d1 of the period is explained. FIG. 4(*a*) shows RGB voltage driving pulses as provided by the LED driving signal generator 114 drawn on a single line. FIG. 4(*b*) shows the RGB current driving waveforms drawn on a single line. The waveform is generated by applying the RGB voltage driving pulse from the voltage-current converter 116 to each LED 140.

FIG. 4(*b*) illustrates a G-LED current driving signal with a turn-off period. Even though a current driving signal G1 is applied, current above a certain threshold level "th" must be applied in order to drive LED 140. Thus, the G-LED will illuminate (turn on) when the current waveform reaches the $R_G$ point. On the other hand, in the case of the R-current driving signal, the R-LED is turned off when the current reaches the $F_R$ point. Accordingly, the period during which the LED is turned off occurs during the period from $F_R$ to $R_G$, which is identified as period d1. This period is the "off-period," and it occurs when a normal voltage driving signal is applied so that the period can be utilized for on-time.

The off-period occurs between the RGB signals. Thus, the width of each driving pulse can be increased by the period d1. That is, the LED driving signal generator 114 can increase the pulse width of each LED driving signal by the period d1 and apply the overlapped driving signal. In this manner, the driving time of the LED can be increased by an amount equal to the period d1.

The display device driver 112 is configured to supply a driving signal to display device 150 and to supply R-frame data, G-frame data, and B-frame data for driving the RGB LED 140. Display device driver 112 supplies a signal to LED driving signal generator 114 in which period detector 190 detects the width d1 of the period where the LED is off, and the width of each pulse is accordingly modified and applied to the LED driving signal generator 114.

Figure 5:
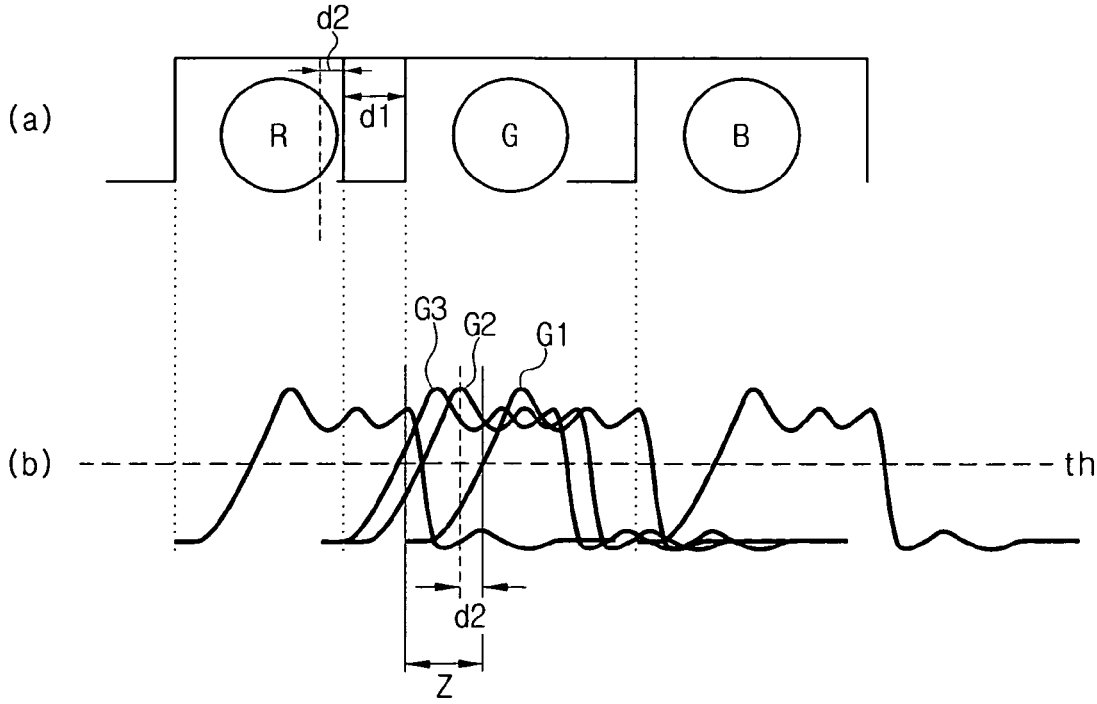
FIG. 5 shows a period during which the LED is not being used for image display.

In reference to FIG. 5, a width d2 is also determined. The width d2 represents a period during which the pulse is not being used for displaying an image. The width of each pulse is modified by the amount of period d2 and applied to the LED driving signal generator 114. See FIGS. 5(*a*) and 5(*b*). That is, the LED driving signal generator 114 can increase the pulse width of each LED driving signal for the period d2, and apply the overlapped driving signal. In FIG. 5(*b*), Z is the sum of periods d1 and d2.

Generally, eight colors can be represented in response to the RGB 3-bit color combination data, and a plurality of colors can be represented by setting the duty and period of the LED 140 driving signal of each RGB in several steps. More colors can be represented by a faster duty control.

In one exemplary embodiment, the display apparatus using the LED driving method is controlled such that the current flowing from the voltage-current converter 116 to the LED 140 is switched on and off by the voltage-controlled LED driving signal generator 114. Current detector 170 and current controller 160 maintain the current flowing through LED 140 at a constant so that LED brightness can be constant.

Figure 7:
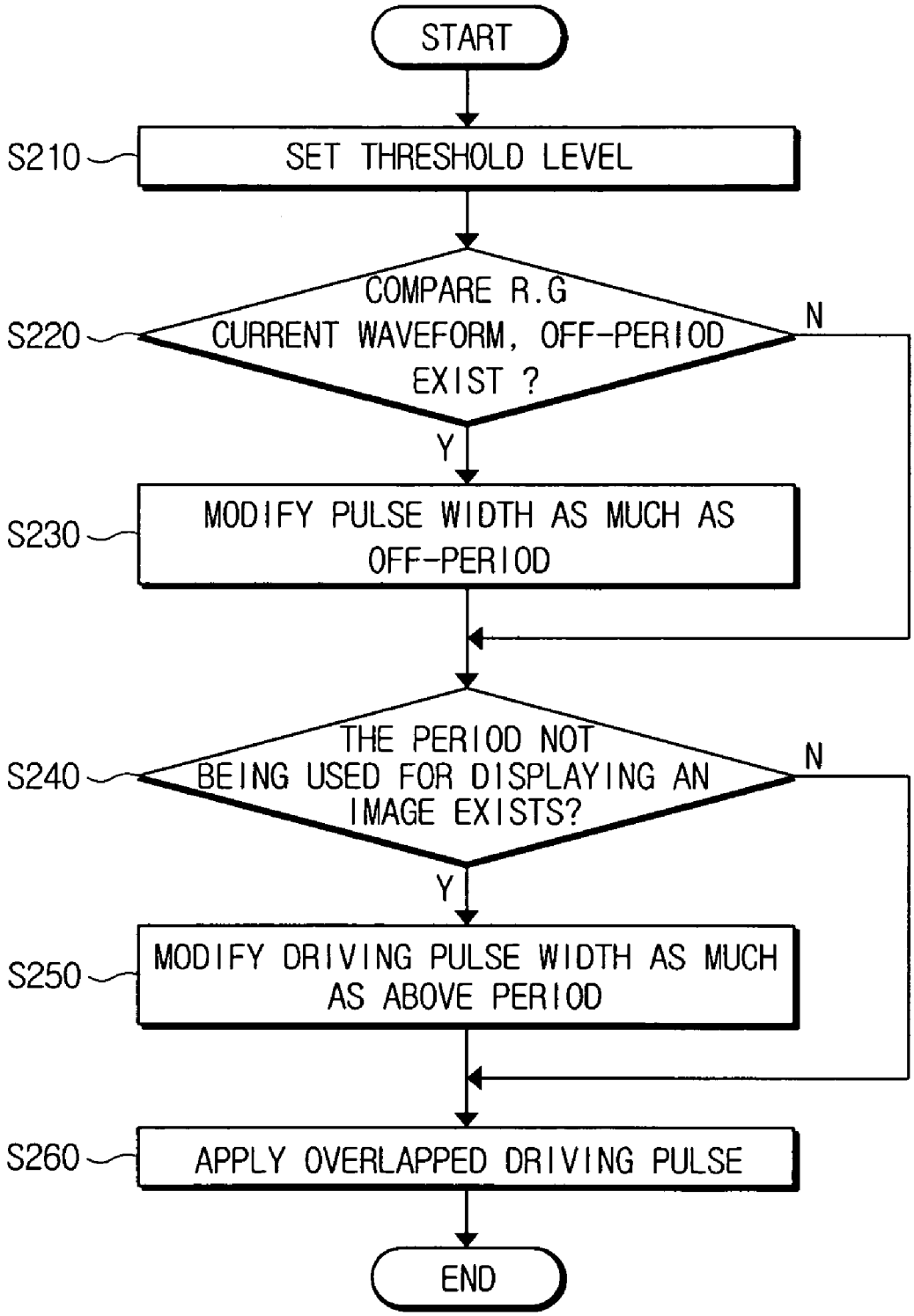
FIG. 7 shows a flow chart explaining the driving method of a display apparatus using an LED driving method in accordance with an embodiment of the present invention.

FIG. 7 illustrates a flow chart of the steps of a method of driving the display apparatus using the LED driving method according to one embodiment of the invention.

At step S210, a threshold level for an appropriate current level for driving LED 140 is set in period detector 190. The threshold level is denoted by "th" in each figure. This process can be embodied in hardware, and where the input is a current level converted into a digital value, an appropriate current level can be established.

The period detector 190 compares the current waveforms that drive RGB LED 140 and detects whether there are any periods during which each LED 140 is turned off, as performed in step S220. If an off-period is detected in step S220 and the value of the detected period (d1) is fed back, the display device driver 112 at step S230 modifies the data so that the on-period of each RGB LED 140 is overlapped by the amount of the detected period, d1. This results in the LED driving signal generator 114 outputting the overlapped RGB voltage driving waveform.

At step S240, the display device driver 112 judges whether a period exists in which a display is not being used for displaying an image. This period is d2. If a period d2 exists as the result of the determination at step S240, at step S250 the data is modified to overlap the on-period of each RGB by the period described above and outputted to the LED driving signal generator 114 at step S260.

Accordingly, the modified voltage driving signal and current driving waveform outputted at step S260 has an overlap by as much as the modified width d1+d2 of each RGB signal. In this manner, the lighting time of each image displaying LED can be extended by as much as "d1+d2."

Figure 6:
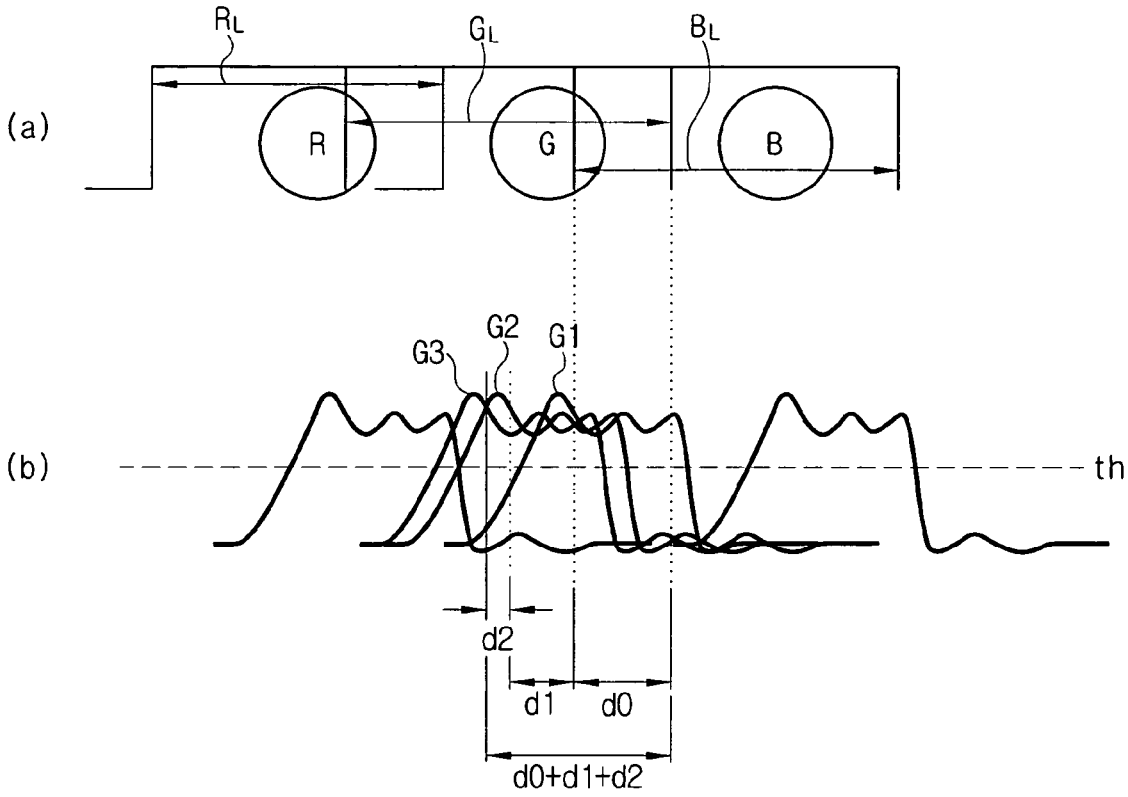
FIG. 6 shows a driving signal modified in accordance with an embodiment of the present invention.

FIG. 6 shows a signal modified in accordance with an embodiment of the present invention. FIG. 6(*a*) shows a modified voltage driving signal supplied by the LED driving signal generator 114, and FIG. 6(*b*) shows a modified current driving waveform supplied by the voltage-current converter 116.

If an LED off-period d1 and a period d2 (where an image is not being displayed) are determined as described above, the modified RGB voltage driving signals $R_L$, $G_L$, & $B_L$ outputted from the LED driving signal generator 114 are increased by as much as the width of d1+d2 respectively. This width is wider than the pulse width $R_F$, $G_F$, & $B_F$ before modification, as shown in FIG. 4(*a*). Thus, in FIG. 6(*b*), the modified width $G_L$ of the voltage driving signal of the G-LED is applied after being overlapped by width d1+d2 in the direction of the voltage driving signal of the R-LED, and the modified width $B_L$ of the voltage driving signal of the B-LED is applied after being overlapped by as much as width d1+d2 in the direction of the voltage driving signal of the G-LED. Also, $R_L$ is applied after being increased in the direction of the voltage driving signal of the B-LED.

The modified RGB voltage driving signals $R_L$, $G_L$, & $B_L$ are output from the LED driving signal generator 114 and applied to LED 140, via the voltage-current converter 116. The current signal waveform then has a width that is wider than the lighting time d0 of the G-LED prior to modification. The increase in width can be as much as d1+d2. Thus, the lighting time of each RGB LED is extended by as much as d1+d2. In FIG. 6(*b*), G1 is the current driving waveform of the G-LED, G2 is the waveform modified due to off-period d1 of the LED, and G3 is the waveform modified due to the period d2 not being used for displaying an image.

In one embodiment of the invention, it is explained that the period detector 190 determines the period where each LED is turned off, and transmits that period. However, display device driver 112 can also determine the period using a feedback signal.

By improving the signal waveform driving the LED, the period during which all the LEDs are turned off is improved. Also, any periods that are not used—even while the LED is turned on for fear of screen distortion due to the overshoot—is improved. Thus, LED lighting time is extended, and brightness improved. By applying an overlapped pulse to drive the LED, an image can be displayed for a longer period than is possible with a conventional image display.

Although a preferred embodiment of the present invention has been described, it will be understood by those skilled in the art that the present invention should not be limited to the described preferred embodiment, but various changes and modifications can be made within the spirit and scope of the present invention as defined by the appended claims.

What is claimed is:

1. A device for driving at least one light emitting diode, comprising:

an LED driver for providing a driving signal for controlling ON/OFF switching of the light emitting diode; and a period detector for detecting a period during which the driving signal is off, and outputting the detected period to the LED driver, wherein the LED driver is configured to add the period detected to a diode turn-on driving signal for the duration of the period amount so that the driving signals for each diode in the array overlap each other by the period amount.

2. The device as claimed in claim 1, wherein the driving signal is a square waveform.

3. The device as claimed in claim 2, wherein the square waveform has a predetermined pulse width.

4. The device as claimed in claim 1, wherein the LED driver includes:

a display device driver for outputting data for controlling ON/OFF switching of the light emitting diode;

a driving signal generator for receiving data from the display device driver and outputting a voltage driving signal for controlling ON/OFF switching of the light emitting diode; and a voltage-current converter for converting the voltage driving signal to a current driving waveform for controlling brightness of the light emitting diode and applying the current driving waveform to the light emitting diode.

5. The device as claimed in claim 4, wherein the period detector receives the current driving waveform applied to the light emitting diode from the voltage-current converter and performs period detection.

6. The device as claimed in claim 4, wherein the voltage driving signal is a square waveform.

7. The device as claimed in claim 4, wherein the voltage-current converter detects an amount of current flowing through the light emitting diode in order to control the amount of current so that the current which flows through the light emitting diode is constant.

8. A display apparatus having at least one light emitting diode, the display apparatus comprising:

an LED driver for outputting a driving signal for controlling ON/OFF switching of each light emitting diode;

a current detector for detecting an amount of current flowing through each light emitting diode, wherein the LED driver is configured to receive detected data from the current detector and control the amount of current so that current flow through the light emitting diode is constant; and a period detector for detecting a period during which all diving signals applied to each light emitting diode are turned off, and outputting the detected period to the LED driver, wherein the LED driver is configured to add the period detected to the turn-on diving signal of the light emitting diode so that the turn-on driving signal overlap each other by the period amount.

9. The display apparatus as claimed in claim 8, wherein the period detector is configured to detect a second period, the second period being a duration when no image signal is conveyed to the display apparatus, the LED driver being further configured to add the second period to the diode turn-on driving signal.

10. The display apparatus as claimed in claim 8, wherein the driving signal is a square waveform.

11. The display apparatus as claimed in claim 10, wherein the square waveform has a predetermined pulse width.

12. The display apparatus as claimed in claim 8, wherein the LED driver includes:

a display device driver for outputting data for controlling ON/OFF switching of each light emitting diode;

a driving signal generator for receiving data from the display device driver and outputting a voltage driving signal for controlling ON/OFF switching of each light emitting diode; and a voltage-converter for converting the voltage driving signal to a current driving waveform for controlling brightness of the light emitting diode, and applying the current driving waveform to the light emitting diode.

13. The display apparatus as claimed in claim 12, wherein the voltage driving signal is a square waveform.

14. A display apparatus having at least one light emitting diode, the display apparatus comprising:

an LED driver for outputting a driving signal for controlling ON/OFF switching of each light emitting diode;

a current detector for detecting an amount of current flowing through each light emitting diode, wherein the LED driver is configured to receive detected data from the current detector and control the amount of current so that current flow through the light emitting diode is constant; and a period detector for detecting a period during which all driving signals applied to each light emitting diode are turned off, and outputting the detected period to the LED driver, the LED driver being configured to add the period detected to the diode turn-on driving signal so that the turn-on driving signals overlap each other by the period amount, wherein the period detector is configured to receive the current driving waveform and performs period detection.

15. The display apparatus as claimed in claim 12, wherein the voltage-current converter is further configured to receive the amount of current detected by the current detector and controls the amount of current so that the current flow through the light emitting diode is constant.

16. A method of controlling a driving pulse for a display apparatus having at least one light emitting diode adapted to display an image, the method comprising:

detecting a period during which all the light emitting diodes are turned off; and adding the detected period to a turn-on driving signal of the light emitting diode;

wherein the turn-on driving signal of each diode overlap each other by the detected period.

17. The method as claimed in claim 16, wherein a second period is detected, the second period being a duration when no image signal is conveyed to the display apparatus, and added to the turn-on driving signal.

18. A method of controlling a driving pulse for a light emitting diode array, the method comprising the steps of:

outputting at least one driving signals for controlling ON/OFF switching of each light emitting diode within the array;

detecting a period during which all driving signals applied to the light emitting diode array are turned off;

adding the detected period to a diode turn-on driving signal; and applying the diode turn-on driving signal to each light emitting diode within the array so that the signals through the diodes in the array overlap by the detected period.

19. The method as claimed in claim 18, wherein the detecting step further detects a second period, the second period being a duration when no image signal is conveyed to the array, and the applying step further adding the second period to the turn-on driving signal.

20. The method as claimed in claim 19, wherein outputting the at least one driving signal further includes the steps of:

outputting control data for controlling ON/OFF switching of each light emitting diode;

outputting a voltage driving signal for controlling ON/OFF switching of each light emitting diode after receiving data from the control data outputting step; and converting the voltage driving signal into a current driving waveform for controlling brightness.

21. The method as claimed in claim 20, wherein the voltage driving signal is a square waveform.

22. The method as claimed in claim 20, wherein the period detecting step receives the current driving waveform and performs period detection on the waveform.

23. The method as claimed in claim 20, wherein the amount of current flowing through the light emitting diode array is detected in order to control the amount of current so that current flow through the array is constant.

24. A method of controlling a driving pulse for a display apparatus having a light emitting diode array adapted to display an image, the method comprising the steps of:

outputting one or more driving signals for controlling ON/OFF switching of each light emitting diode within the array;

detecting an amount of current flowing through each light emitting diode;

controlling the amount of current so that the current flowing through the light emitting diode array is constant detecting a period where all the driving signals applied to the light emitting diode array are turned off, outputting the detected period to an LED driver; and applying a turn-on driving signal to each light emitting diode within the array so that the driving signals overlap each other by the detected period.

25. The method as claimed in claim 24, further comprising:

detecting a second period, the second period being a duration when no image signal is conveyed to the array; and adding the detected second period to the turn-on driving signal.

26. The method as claimed in claim 24, wherein the driving signal is a square waveform.

27. The method as claimed in claim 24, wherein outputting the one or more driving signals includes the steps of:

outputting data for controlling ON/OFF switching of each light emitting diode;

outputting a voltage driving signal for controlling ON/OFF switching of each light emitting diode after receiving data from the outputting data step; and converting the voltage driving signal to a current driving waveform for controlling brightness.

28. The method as claimed in claim 27, further comprising:

detecting a period where all the driving signals applied to the light emitting diode array are turned off, providing the detected period to an LED driver; and applying a turn-on driving signal to each light emitting diode of the array so that the driving signals overlap each other by the detected period, wherein the period detecting step receives the current driving waveform and performs period detection.

29. The method as claimed in claim 27, further comprising:

applying the current driving waveform to include detecting the amount of current flowing through the light emitting diode array in order to control the amount of current so that a constant current flows through the light emitting diode array.

30. A computer readable medium having stored thereon instructions for controlling a driving pulse for a display apparatus having a light emitting diode array adapted to display an image, comprising:

a set of instructions for outputting one or more driving signals for controlling ON/OFF switching of each light emitting diode within the array;

a set of instructions for detecting an amount of current flowing through each light emitting diode;

a set of instructions for controlling the amount of current so that the current flowing through the light emitting diode array is constant a set of instructions for detecting a period where all the driving signals applied to the light emitting diode array are turned off;

a set of instructions for outputting the detected period to an LED driver; and a set of instructions for applying a turn-on driving signal to each light emitting diode within the array so that the driving signals overlap each other by the detected period.

31. The computer readable medium as claimed in claim 30, further comprising:

a set of instructions for detecting a second period, the second period being a duration when no image signal is conveyed to the array; and a set of instructions for adding the detected second period to the turn-on driving signal.

32. The computer readable medium as claimed in claim 30, wherein the set of instructions for outputting the one or more driving signals includes:

a set of instructions for outputting data for controlling ON/OFF switching of each light emitting diode;

a set of instructions for outputting a voltage driving signal for controlling ON/OFF switching of each light emitting diode after receiving data provided by the outputting data instructions; and a set of instructions for converting the voltage driving signal to a current driving waveform for controlling brightness.

33. A computer readable medium having stored thereon instructions for controlling a driving pulse for a display apparatus having a light emitting diode array adapted to display an image, comprising:

a set of instructions for outputting one or more driving signals for controlling ON/OFF switching of each light emitting diode within the array;

a set of instructions for detecting an amount of current flowing through each light emitting diode;

a set of instructions for detecting a period where all the driving signals applied to the light emitting diode array are turned off;

a set of instructions for providing the detected period to an LED driver; and a set of instructions for applying a turn-on driving signal to each light emitting diode of the array so that the driving signals overlap each other by the detected period, wherein the set of instructions for period detecting include instructions to receive the current driving waveform and perform period detection.

34. The computer readable medium as claimed in claim 33, further comprising:

a set of instructions for applying the current driving waveform to detect the amount of current flowing through the light emitting diode array in order to control the amount of current so that a constant current flows through the light emitting diode array.

* * * * *